US008162635B2

(12) United States Patent
Mizuno et al.

(10) Patent No.: US 8,162,635 B2
(45) Date of Patent: Apr. 24, 2012

(54) LOW VIBRATION PUMP

(75) Inventors: Kenji Mizuno, Tokyo (JP); Yasumasa Oki, Tokyo (JP)

(73) Assignee: Nitto Kohki Co., Ltd., Tokyo (JP)

( * ) Notice: Subject to any disclaimer, the term of this patent is extended or adjusted under 35 U.S.C. 154(b) by 670 days.

(21) Appl. No.: 12/084,045

(22) PCT Filed: Oct. 19, 2006

(86) PCT No.: PCT/JP2006/320852

§ 371 (c)(1),
(2), (4) Date: Apr. 24, 2008

(87) PCT Pub. No.: WO2007/049503

PCT Pub. Date: May 3, 2007

(65) Prior Publication Data

US 2009/0155105 A1 Jun. 18, 2009

(30) Foreign Application Priority Data

Oct. 25, 2005 (JP) ..... 2005-310391

(51) Int. Cl.
*F04B 11/00* (2006.01)

(52) U.S. Cl. ..... 417/540; 417/542; 417/543

(58) Field of Classification Search ..... 417/540, 417/542, 543

See application file for complete search history.

(56) References Cited

U.S. PATENT DOCUMENTS

| | | | | |
|---|---|---|---|---|
| 2,042,510 | A * | 6/1936 | Cornelius et al. | 417/44.5 |
| 3,000,320 | A * | 9/1961 | Ring | 417/383 |
| 3,867,963 | A * | 2/1975 | Ballard | 138/46 |
| 3,941,519 | A * | 3/1976 | McCauley | 417/560 |
| 4,265,600 | A * | 5/1981 | Mandroian | 417/379 |
| 4,594,059 | A | 6/1986 | Becker | |
| 5,096,400 | A * | 3/1992 | Budecker et al. | 417/540 |
| 5,210,382 | A * | 5/1993 | Paley et al. | 181/209 |
| 5,335,584 | A * | 8/1994 | Baird | 92/98 R |
| 7,278,835 | B2 * | 10/2007 | Schmitt et al. | 417/470 |
| 2005/0112004 | A1 | 5/2005 | Becker et al. | |

FOREIGN PATENT DOCUMENTS

| | | |
|---|---|---|
| GB | 2 110 312 | 6/1983 |
| JP | 54-034109 | 3/1979 |
| JP | 58-104379 | 6/1983 |
| JP | 2-112981 | 9/1990 |
| JP | 7-27043 | 1/1995 |

(Continued)

OTHER PUBLICATIONS

International Search Report issued Dec. 26, 2006 in International (PCT) Application No. PCT/JP2006/320852. Supplementary European Search Report issued Apr. 14, 2011 in European Application No. 06812030.2.

*Primary Examiner* — Charles Freay

*Assistant Examiner* — Christopher Bobish

(74) *Attorney, Agent, or Firm* — Wenderoth, Lind & Ponack, L.L.P.

(57) ABSTRACT

A liquid pump is provided in which pulsations can be properly absorbed even if the pump is driven at a high frequency. A pulsation absorbing unit for absorbing pulsation includes a pulsation absorbing housing disposed on a pump housing member, a second diaphragm attached to the pulsation absorbing housing member and defining a pulsation absorbing chamber communicating with a liquid outlet passage of a liquid pump unit, and a disc spring for biasing the second diaphragm toward the pulsation absorbing chamber.

8 Claims, 7 Drawing Sheets

FOREIGN PATENT DOCUMENTS

| | | |
|---|---|---|
| JP | 10-19652 | 1/1998 |
| JP | 10-89258 | 4/1998 |
| JP | 10-196521 | 7/1998 |
| JP | 2001-355568 | 12/2001 |
| JP | 2004-124894 | 4/2004 |
| JP | 2005-527727 | 9/2005 |
| WO | 03/078841 | 9/2003 |

* cited by examiner

LOW VIBRATION PUMP

BACKGROUND OF THE INVENTION

I. Technical Field

The present invention relates to a low vibration pump in which a pulsation absorbing unit is integrally provided to a pump for sucking and discharging liquid by reciprocation.

II. Description of the Related Art

In use of such a reciprocating liquid pump, the occurrence of discharge pressure pulsation cannot be avoided. Therefore, according to the application and the intended use of an object to which pressure is supplied, pumps having a structure in which the pulsation can be reduced have been developed. (for example, Japanese Patent Application Publication No. 2001-355568)

However, in such a conventional reciprocating liquid pump with a pulsation absorbing unit, the pulsation absorbing unit is complicated in structure and large in size, which is not suitable for a small-sized liquid pump in which reciprocation period is short.

SUMMARY OF THE INVENTION

In view of the foregoing, it is an object of the present invention to provide a reciprocating liquid pump with a pulsation absorbing unit which is uncomplicated in structure and suitable for downsizing.

The present invention provides a low vibration pump including a liquid pump unit and a pulsation absorbing unit. The liquid pump unit includes a pump housing, a first diaphragm attached to the pump housing and defining a pump chamber in the pump housing, a liquid inlet passage for supplying liquid from the outside of the pump housing to the pump chamber, a liquid outlet passage for discharging the liquid from the pump chamber to the outside of the pump housing, an electric rotary motor, an eccentric cam drivingly rotated by means of a rotating output shaft of the electric rotary motor, and a connecting rod connected between the eccentric cam and the first diaphragm and reciprocally deforming the first diaphragm in a direction perpendicular to the axial direction of the rotating output shaft according to the rotation of the eccentric cam. The pulsation absorbing unit includes a pulsation absorbing housing disposed on the pump housing, a second diaphragm attached to the pulsation absorbing housing and defining a pulsation absorbing chamber communicating with the liquid outlet passage of the liquid pump unit, and a spring member biasing the second diaphragm toward the pulsation absorbing chamber.

Preferably, the spring member is a disk spring.

In this low vibration pump, the second diaphragm is pressurized by means of the spring member. Therefore, even if pulsation applied to the pulsation absorbing chamber is of high frequency, the second diaphragm can properly absorb the pulsation. Further, the volume occupied by the spring member can be small, whereby it is possible to downsize the pump as a whole.

Specifically, the first and second diaphragms are each flexible at the outer peripheral portion thereof, and stiff at the central portion thereof. The stiff central portions of the first and second diaphragms can be connected by the connecting rod and the spring member, respectively.

The first and second diaphragms can be aligned in an axial direction perpendicular to the axial direction of the rotating output shaft, and be the same in diameter.

More specifically, the rotating output shaft of the electric rotary motor can be connected directly to the eccentric cam.

The output shaft of the electric rotary motor and the eccentric cam are directly connected without the intermediary of a reduction gear, whereby the diaphragm is vibrated at a high frequency.

In the present invention, even if pulsation applied to the pulsation absorbing chamber is of high frequency, it is possible to properly absorb the pulsation. Therefore, the pump can be operated at a high frequency by means of the electric rotary motor without reducing the rotational speed. Further, it is possible to downsize the pump including the pulsation absorbing unit.

DETAILED DESCRIPTION OF THE INVENTION

An embodiment of a reciprocating fluid pump with a pulsation absorbing unit to which the present invention is applied will now be described with reference to the accompanying drawings.

Figure 1:
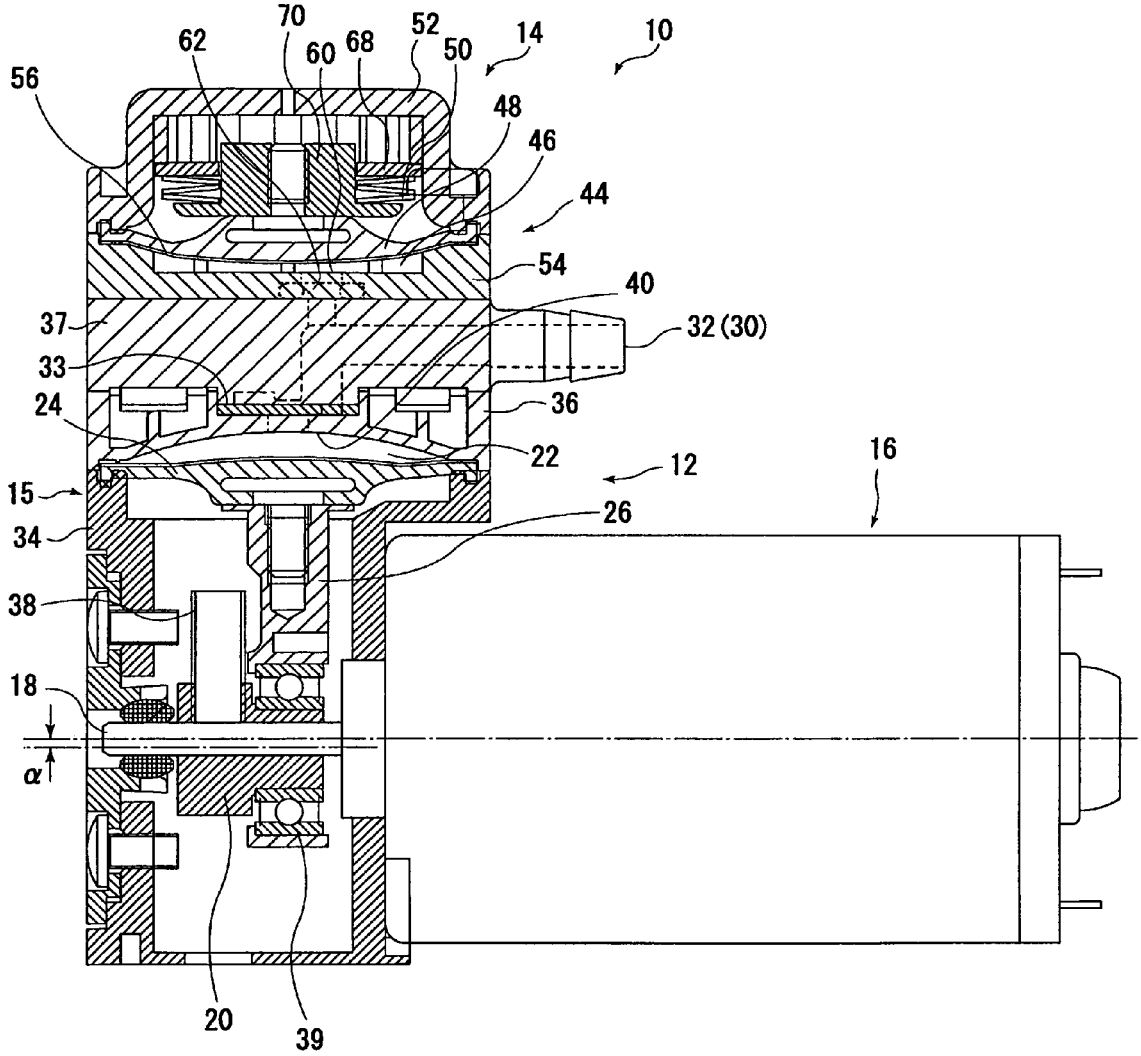
FIG. 1 is a schematic sectional view showing the configuration of a low vibration pump according to the present invention.

FIG. 1 shows a sectional side view of a low vibration pump 10 according to the present invention.

As shown in the figure, the pump includes a liquid pump unit 12 and a pulsation absorbing unit 14.

Figure 2:
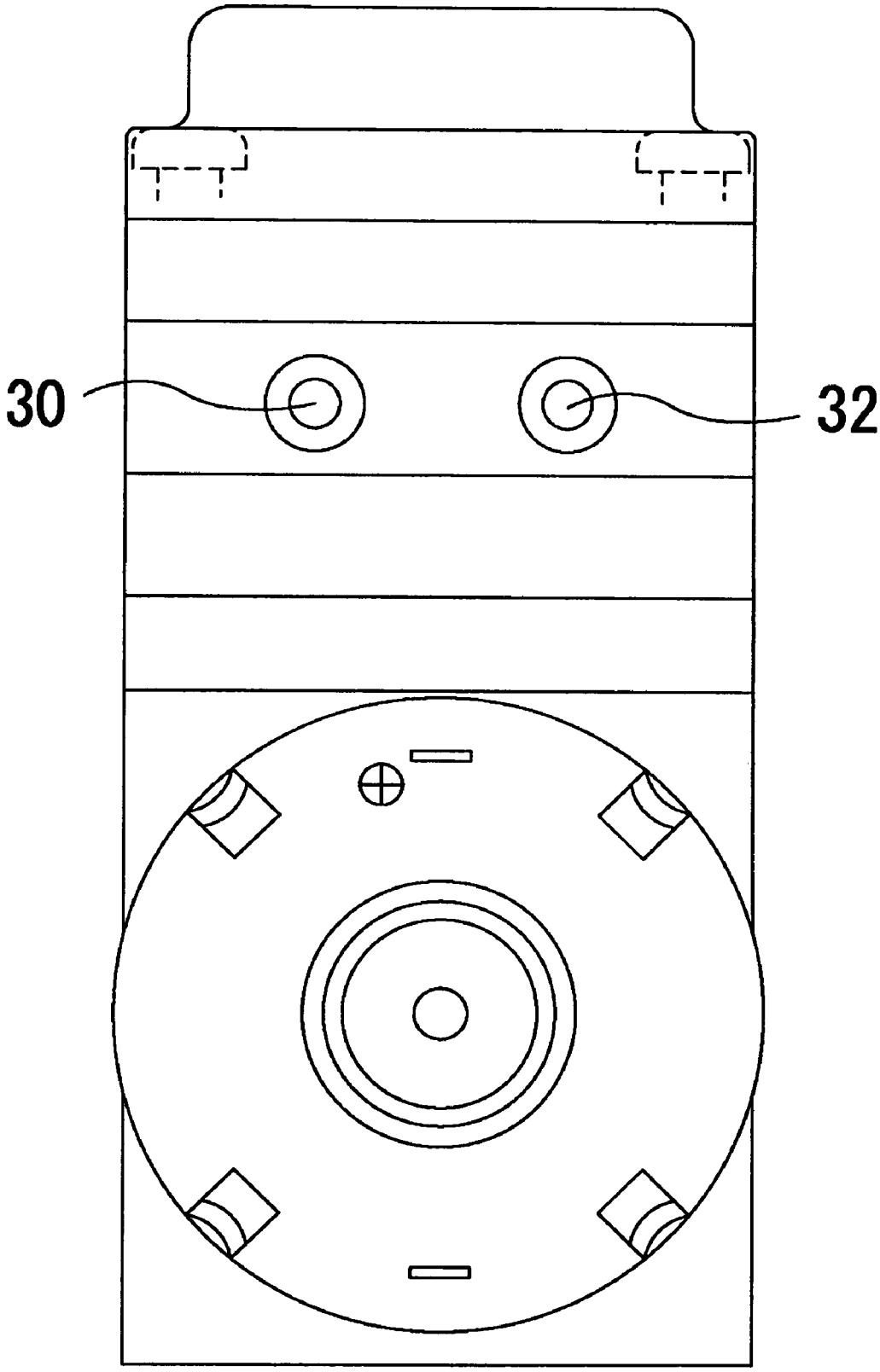
FIG. 2 is a side view of the low vibration pump.

The liquid pump unit 12 includes a pump housing 15, a DC motor 16, an eccentric cam 20 drivingly rotated by means of a rotating output shaft 18 of the DC motor 16, a first diaphragm 24 attached to the pump housing 15 and defining a pump chamber 22 in the pump housing, a connecting rod 26 connected between the eccentric cam 20 and the first diaphragm 24 and reciprocally deforming the first diaphragm 24 in a direction perpendicular to the axial direction of the rotating output shaft 18 according to the rotation of the eccentric cam 20, a liquid inlet passage 30 (FIG. 2) for receiving liquid from an external liquid source (not shown) and transmitting the liquid to the pump chamber 22, and a liquid outlet passage 32 communicating the pump chamber 22 with the outside of the liquid pump unit 12.

More specifically, the pump housing 15 of the liquid pump unit 12 includes a base housing 34 to which the DC motor 16 is attached, an upper housing 36 disposed on the base housing 34 so as to sandwich the diaphragm 24 therebetween and defining the pump chamber 22, and a passage block 37 disposed on and connected to the upper housing 36 and having the liquid inlet passage 30 and the liquid outlet passage 32 passing through the inside of the passage block. The rotating output shaft 18 of the DC motor 16 is arranged to transverse the base housing 34, and the eccentric cam 20 is secured to the rotating output shaft 18 by means of a screw 38. In the illustrated example, the eccentric cam 20 is an eccentric disk attached to the rotating output shaft 18 so as to be offset by an eccentric distance $\alpha$ therefrom. The eccentric disk is connected to the connecting rod 26 through the intermediary of a radial bearing 39. The eccentric disk vertically reciprocates the connecting rod 26 according to the rotation of the DC motor 16, thereby vertically vibrating the diaphragm 24.

The upper housing 36 is formed such that a surface 40 thereof facing the diaphragm 24 is curved convexly. The diaphragm 24 is adapted to vibrate between a liquid sucking state where the diaphragm 24 is apart from the curved surface 40 as shown in FIG. 1 and a liquid discharging state where the diaphragm 24 contacts the curved surface 40 with the curvature thereof being substantially the same as that of the curved surface 40.

The diaphragm 24 is thin and flexible at the outer peripheral portion thereof, and is thick and stiff at the central portion thereof. The stiff central portion is connected by the connecting rod 26.

A check valve 33 (FIG. 1) is disposed in the liquid inlet passage 30 and the liquid outlet passage 32 at the boundary portion between the passage block 37 and the upper housing 36. Thus, liquid can be properly sucked into and discharged from the pump chamber 22 by the vibration of the diaphragm 24.

The pulsation absorbing unit 14 includes a pulsation absorbing housing 44 disposed on the liquid pump unit 12, a second diaphragm 48 attached to the pulsation absorbing housing 44 and defining a pulsation absorbing chamber 46 communicating with the liquid outlet passage 32 of the liquid pump unit 12, and a disk spring 50 for biasing the second diaphragm 48 toward the pulsation absorbing chamber 46.

Figure 3:
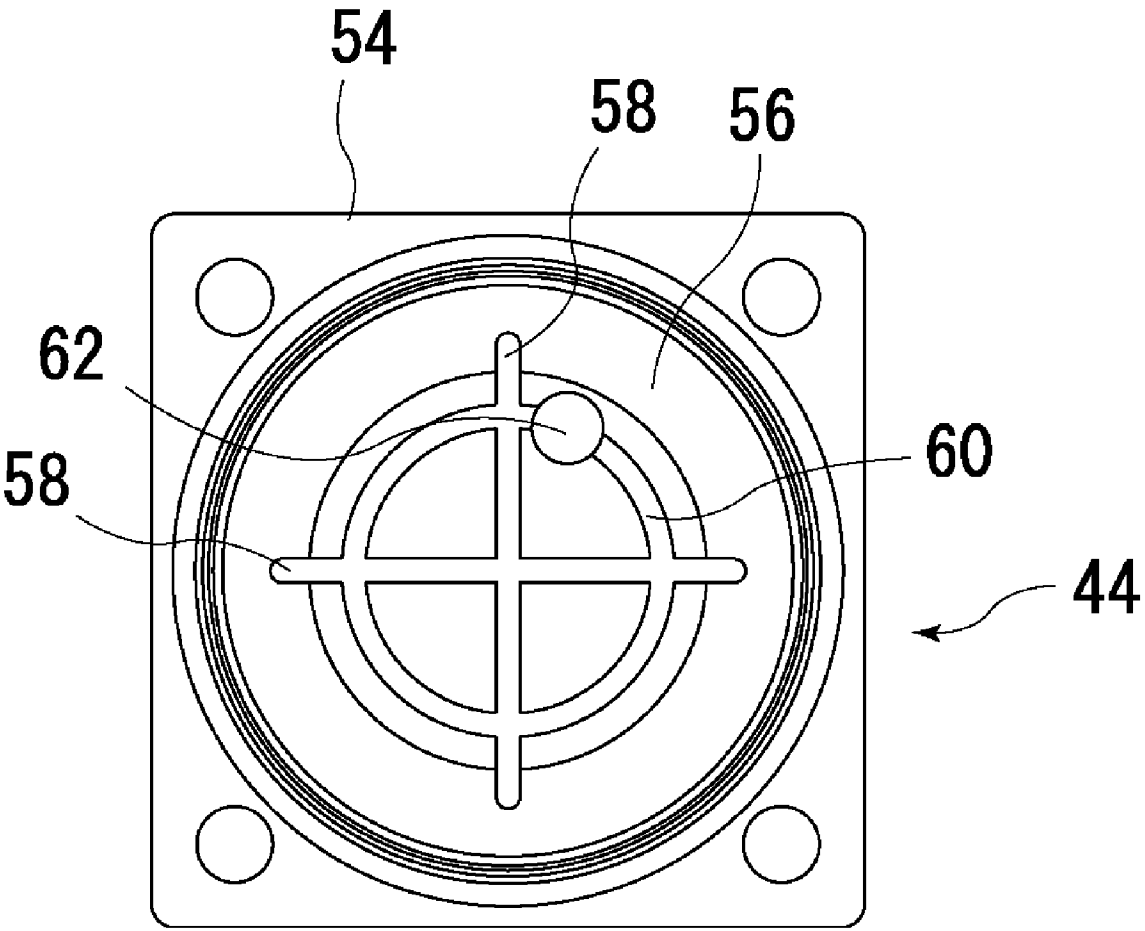
FIG. 3 is a plan view of a lower housing of a pulsation absorbing unit of the low vibration pump.

Specifically, the pulsation absorbing housing 44 has a cap-shaped upper housing 52, and a lower housing 54 connected to the upper housing 52 so as to sandwich the second diaphragm 48 therebetween and defining the pulsation absorbing chamber 46. The lower housing 54 is formed such that a surface 56 thereof facing the second diaphragm 48 is curved concavely. As shown in FIG. 3, which is a top plan view of the lower housing 54, the curved surface 56 is provided with four grooves 58 extending radially from the center thereof and a circular groove 60 communicating the grooves 58 with each other at the middle of the grooves 58. A communicating hole 62 communicating with the liquid outlet passage 32 of the passage block 37 is arranged to be displaced from the center of the curved surface 56 and communicated with the grooves 58. This arrangement enables pressure in the liquid outlet passage 32 to be applied through the grooves 58, 60 to the whole of the diaphragm 48.

The upper housing 52 encases a plurality of disk springs 50 and a holding member 68 for urging the disk springs 50 against the diaphragm 48. The diaphragm 48 is thin and flexible at the outer peripheral portion thereof, and is thick and stiff at the central portion thereof. The stiff central portion is connected by a pressure receiving member 70. The pressure receiving member 70 engages with the lower end of the disk springs 50, thereby applying urging force of the disk springs 50 to the diaphragm 48.

Figure 4:
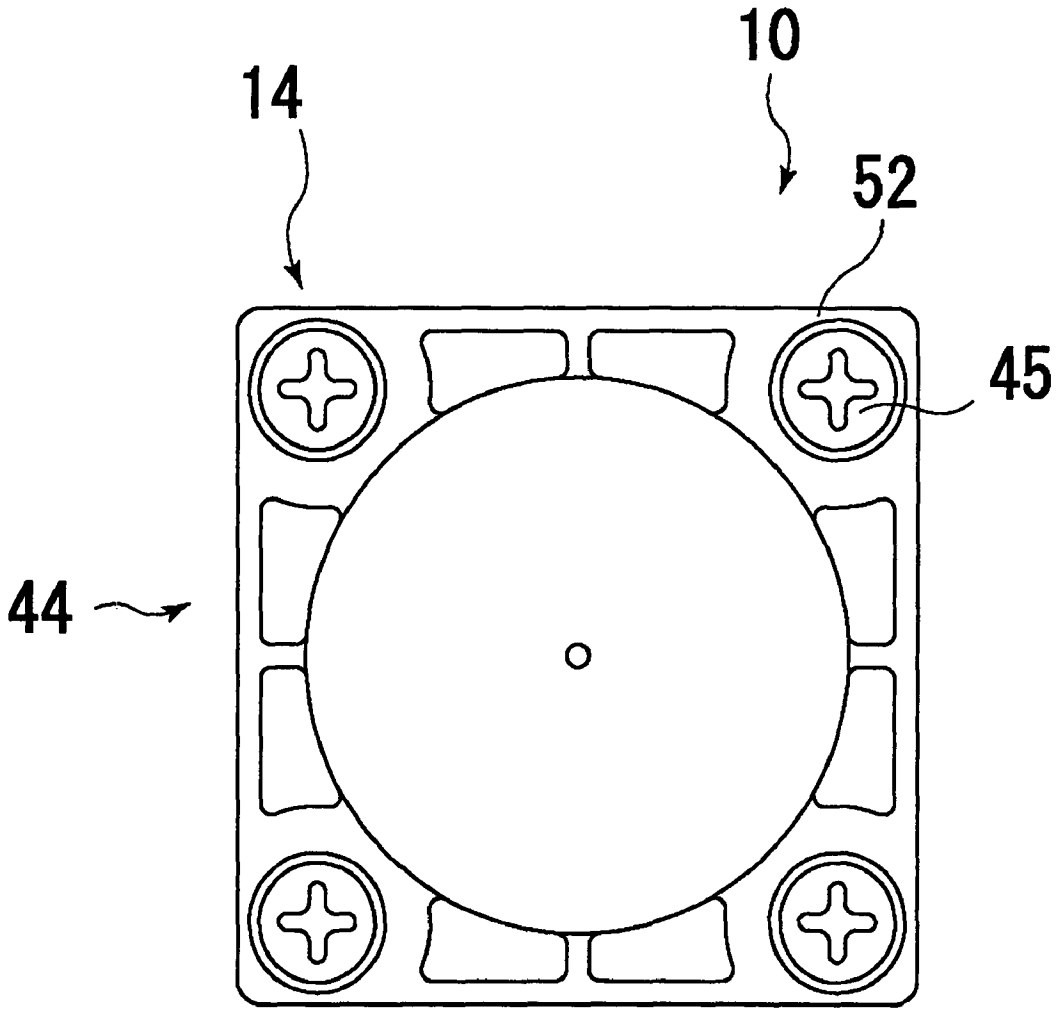
FIG. 4 is a plan view of the low vibration pump.

As shown in FIG. 4, which is a top plan view of the low vibration pump according to the present invention, the pulsation absorbing unit 14 is connected and secured to the pump housing 15 by means of screws 45 screwed downwardly from the four corners of the pulsation absorbing housing 44, through the passage block 37 and the upper housing 36, to the base housing 34.

The diaphragm 24 and the diaphragm 48 are aligned in an axial direction (the vertical direction in the illustrated example) perpendicular to the axial direction of the rotating output shaft 18, and are the same in diameter.

Figure 5:
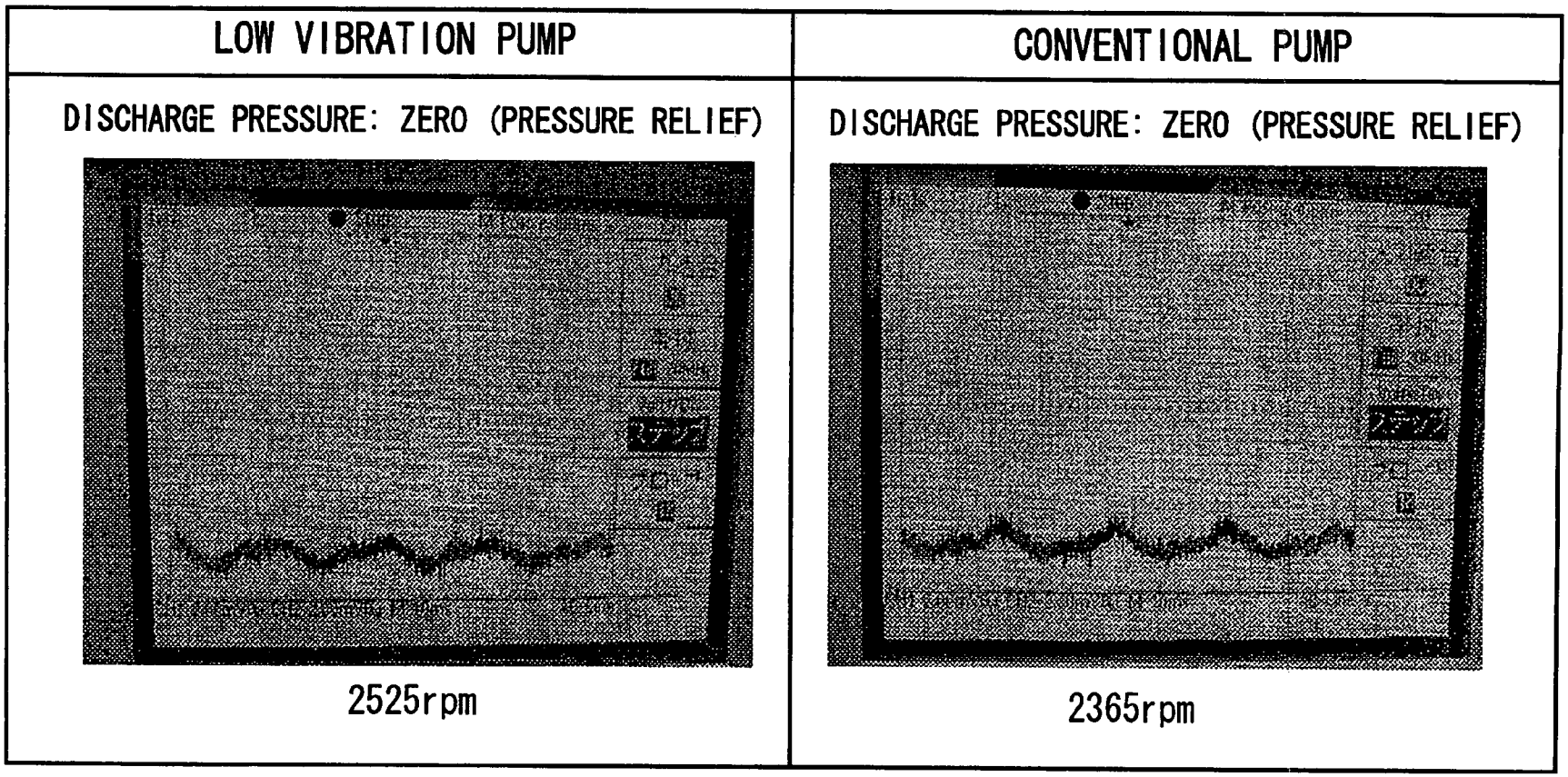
FIG. 5 shows graphs of measurement results of pressure fluctuation (pulsation) in a liquid outlet passage of the low vibration pump according to the present invention, on the condition that the rotational speed of a DC motor is set between about 1800 and 2500 rpm. The left graph shows the measurement result in a case where the pump is equipped with the pulsation absorbing unit, while the right graph shows that in a case where the pump is not equipped with the pulsation absorbing unit. The average pressure is substantially zero in the both cases.
Figure 6:
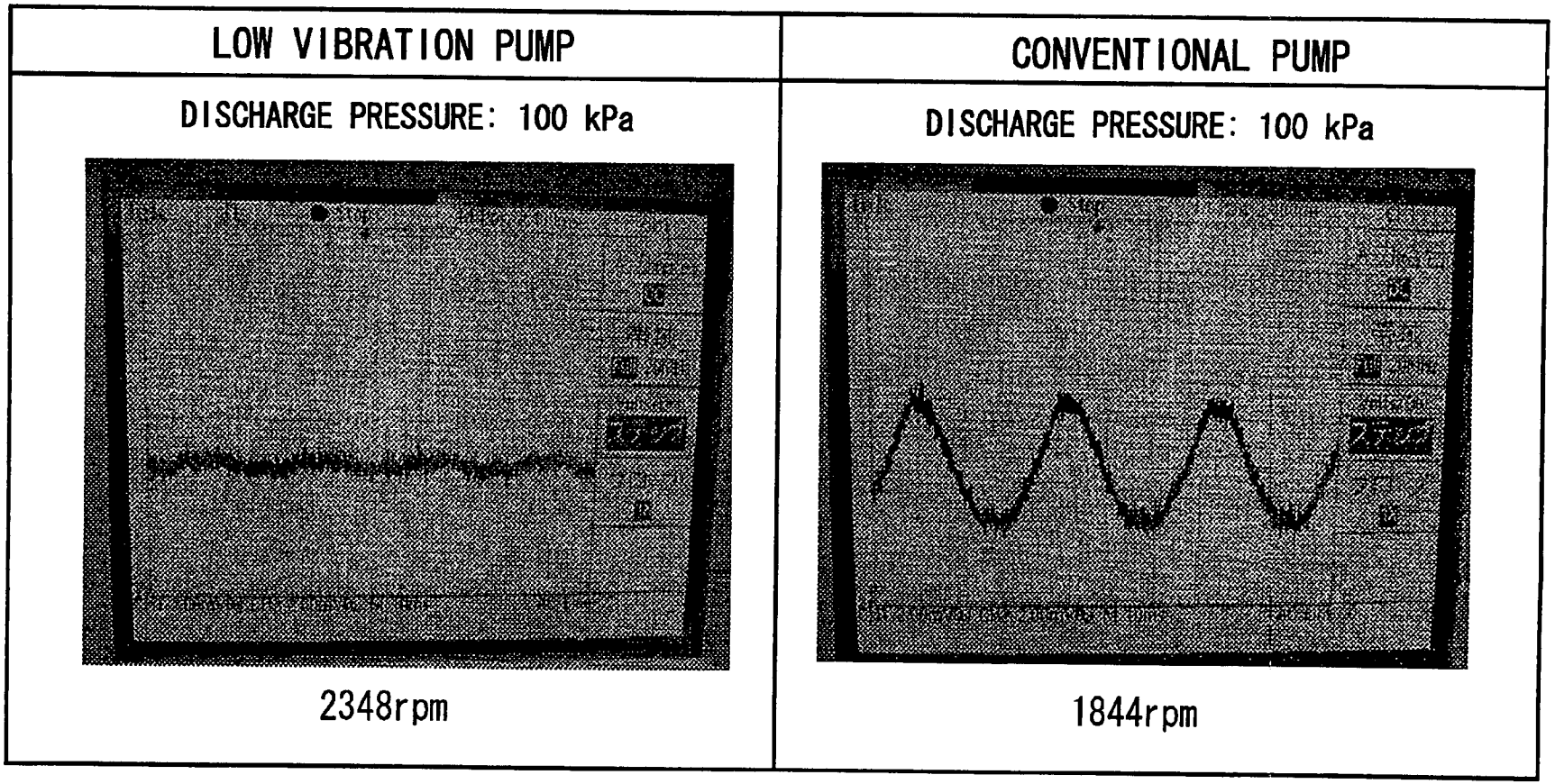
FIG. 6 shows graphs of measurement results same as those in FIG. 5, in a case where the average pressure in the liquid outlet passage is 100 kP.
Figure 7:
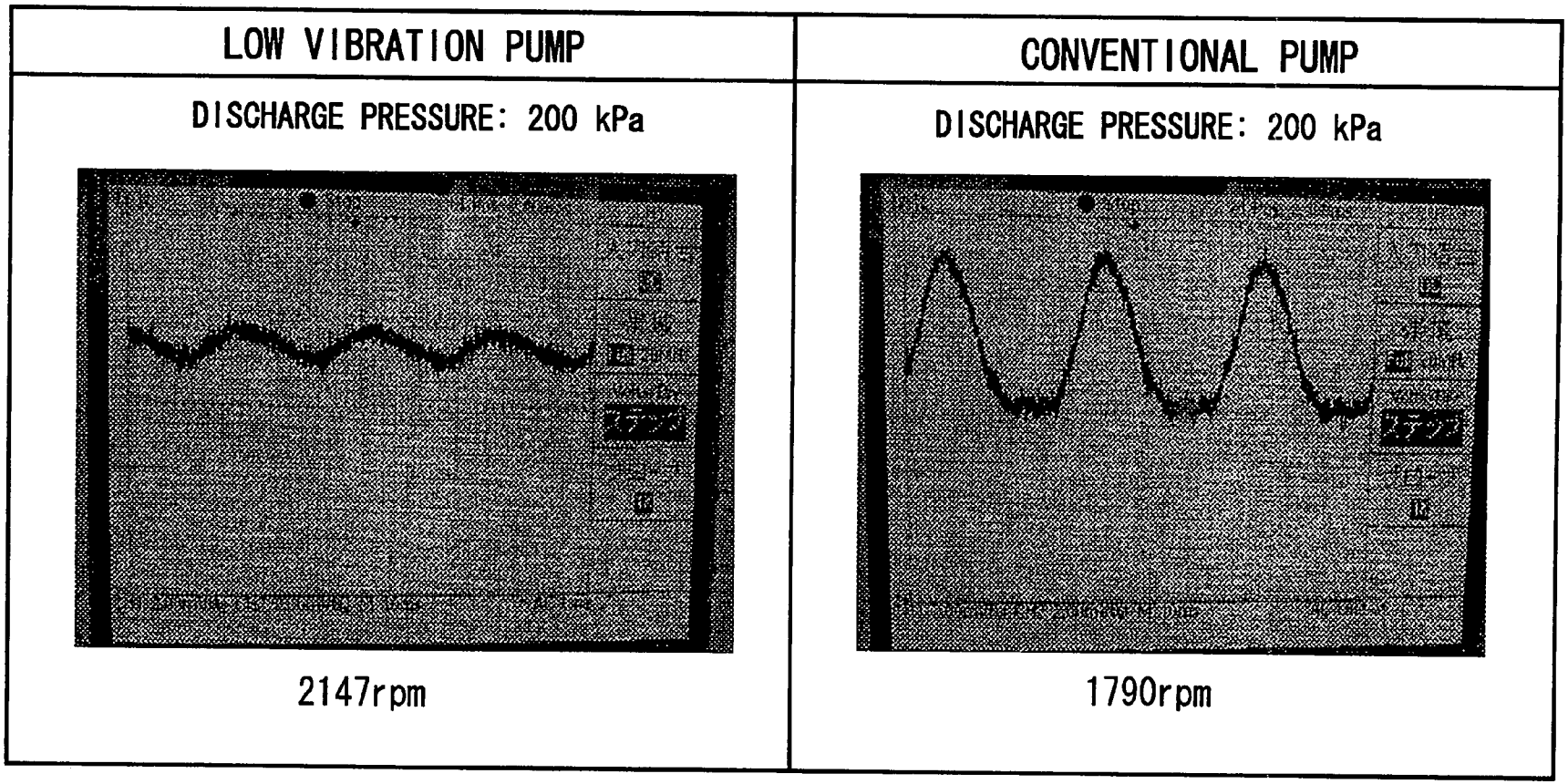
FIG. 7 shows graphs of measurement results same as those in FIG. 5, in a case where the average pressure in the liquid outlet passage is 200 kP.

FIGS. 5 to 7 show graphs of measurement results of pressure fluctuation (pulsation) in the liquid outlet passage 32 of the low vibration pump according to the present invention, in cases where the average pressure in the liquid outlet passage 32 is zero, i.e., the discharge pressure is zero (FIG. 5), 100 kP (FIG. 6), and 200 kP (FIG. 7). The left graphs show the measurement results in a case where the pump is equipped with the pulsation absorbing unit 14, while the right graphs show those in a case where the pump is not equipped with the pulsation absorbing unit 14.

As can be seen from these figures, even if the pump is operated at a high rotational speed with the DC motor being rotated at about 1800 to 2500 rpm, a remarkable effect of pulsation absorption is obtained.

Although the embodiment of the low vibration pump according to the present invention have been described above, the present invention is not necessarily limited to this embodiment. For example, the disk spring may be replaced with a coil spring, a coil spring in which each winding portion is corrugated shaped, or the like.

The invention claimed is:

1. A low vibration pump comprising:

a liquid pump unit; and a pulsation absorbing unit, wherein said liquid pump unit comprises a pump housing including a top wall and a peripheral wall extending downwardly from a periphery of said top wall;

a first diaphragm disposed in said pump housing so as to face said top wall and defining a pump chamber between said top wall and said first diaphragm; and a drive unit connected to a central portion of said first diaphragm and being configured to reciprocally deform said first diaphragm toward and away from said top wall, wherein said pump housing has a liquid inlet passage configured to supply liquid from an outside of said pump housing to said pump chamber, and a liquid outlet passage configured to discharge the liquid from said pump chamber to the outside of said pump housing, wherein said pulsation absorbing unit comprises a pulsation absorbing housing disposed on and secured to said top wall of said pump housing;

a second diaphragm disposed in said pulsation absorbing housing and defining a pulsation absorbing chamber in communication with said liquid outlet passage of said liquid pump unit; and a spring member configured to bias said second diaphragm toward said pulsation absorbing chamber, and wherein said pulsation absorbing housing comprises a cap-shaped upper housing, and a lower housing connected to an upper housing so as to sandwich said second diaphragm therebetween to define said pulsation absorbing chamber, said lower housing having a concave surface facing said second diaphragm with a circular circumferential edge portion along which a circular circumferential edge portion of said second diaphragm is securely held with said circular circumferential edge of said second diaphragm being sandwiched between said lower and upper housings, said concave surface of said lower housing facing said second diaphragm, said concave surface having a plurality of grooves extending radially from a center of said concave surface and a circular groove that are formed in said concave surface and in fluid communication with a communicating hole that is in fluid communication with said liquid outlet passage;

wherein said second diaphragm comprises a circular stiff central portion having a lower surface and an upper surface in a frusto-conical shape with a central flat surface, and an annular flexible portion having an lower surface and an upper surface and extending between said circumferential edge portion of said second diaphragm and said circular stiff central portion, said circular stiff central portion being thicker than the annular flexible portion, wherein said circular circumferential edge portion, said annular flexible portion and said central stiff portion of said second diaphragm are integrally formed as a single unit, said lower surfaces of said circular stiff central portion and said annular flexible portion forming a convex surface complementarily with said concave surface of said lower housing, wherein a pressure receiving member is mounted on said central flat surface of said second diaphragm, and wherein said spring member comprises a plurality of disk springs disposed between said pressure receiving member and an interior wall of said upper housing, and being configured to apply an urging force to place the lower convex surface of said second diaphragm adjacent to said concave surface of said lower housing.

2. A low vibration pump according to claim 1, wherein said pump housing comprises:

a base housing including an upper periphery sealingly engaging with a periphery of said first diaphragm and a wall extending downwardly from said upper periphery; and, an upper housing mounted on and secured to said base housing and having a wall surface which sealingly engages with said upper periphery sealingly engaging with said first diaphragm and faces said upper surface of said first diaphragm to define said pump chamber between said first diaphragm and said wall surface.

3. A low vibration pump according to claim 2, wherein said pump housing comprises a passage block mounted on and secured to said the upper housing and having said liquid inlet passage and said liquid outlet passage, and wherein said pulsation absorbing housing is mounted on and secured to said passage block.

4. A low vibration pump according to claim 1, wherein said drive unit comprises an electric rotary motor attached to said pump housing, an eccentric cam driven by said electric rotary motor to rotate about an axis extending substantially parallel with said top wall, and a connecting rod connected between said eccentric cam and central portion of said first diaphragm and configured to reciprocally deform said first diaphragm in a direction perpendicular to the axis according to the rotation of said eccentric cam.

5. A low vibration pump according to claim 4, wherein of said first diaphragm is stiff at said central portion thereof and flexible at an annular portion between said central portion and a periphery thereof, and said stiff central portion of said first diaphragm and said circular stiff central portion of said second diaphragm are connected by said connecting rod and said spring member, respectively.

6. A low vibration pump according to claim 1, wherein said first and second diaphragms have the same diameter.

7. A low vibration pump according to claim 4, wherein said electric rotary motor includes a rotating output shaft connected directly to said eccentric cam.

8. A low vibration pump according to claim 1, wherein said spring is configured to bias said second diaphragm toward said concave surface of said pulsation absorption chamber.

* * * * *